United States Patent [19]

Sammells

[11] Patent Number: 4,608,132

[45] Date of Patent: Aug. 26, 1986

[54] MEANS AND METHOD FOR THE ELECTROCHEMICAL REDUCTION OF CARBON DIOXIDE TO PROVIDE A PRODUCT

[75] Inventor: Anthony F. Sammells, Naperville, Ill.

[73] Assignee: Texaco Inc., White Plains, N.Y.

[21] Appl. No.: 741,781

[22] Filed: Jun. 6, 1985

[51] Int. Cl.[4] ..... C25B 3/04

[52] U.S. Cl. ..... 204/59 R; 204/72; 204/265

[58] Field of Search ..... 204/72, 75, 237, 242, 204/252, 263, 264, 265, 59 R

[56] References Cited

U.S. PATENT DOCUMENTS

| | | | |
|---|---|---|---|
| 3,220,941 | 11/1965 | Osborne | 204/72 |
| 3,766,027 | 10/1973 | Gregory | 204/72 |
| 3,959,094 | 5/1976 | Steinberg | 204/72 |
| 4,219,392 | 8/1980 | Halmann | 204/72 |
| 4,240,882 | 12/1980 | Ang et al. | 204/72 |
| 4,381,978 | 5/1983 | Gratzel et al. | 204/72 |
| 4,523,981 | 6/1985 | Ang et al. | 204/72 |

FOREIGN PATENT DOCUMENTS

| | | | |
|---|---|---|---|
| 3246070 | 6/1984 | Fed. Rep. of Germany | 204/72 |

*Primary Examiner*—John F. Niebling
*Assistant Examiner*—Terryence Chapman
*Attorney, Agent, or Firm*—Robert A. Kulason; James J. O'Loughlin; Ronald G. Gillespie

[57] ABSTRACT

Apparatus and method for the electrochemical reduction of carbon dioxide to a product includes a housing divided into two sections by membrane. An electrolyte solution including a non-aqueous electrolyte dimethylformamide and a supporting electrolyte is provided to the two sections of the housing. A n-Si cathode is located in one section of the housing while an anode is located in the other section. Carbon dioxide is provided to the section having the cathode. A direct voltage is provided to the cathode and to the anode so that a current can pass and cooperate in a reaction between the carbon dioxide and the electrolyte solution to provide a product.

25 Claims, 1 Drawing Figure

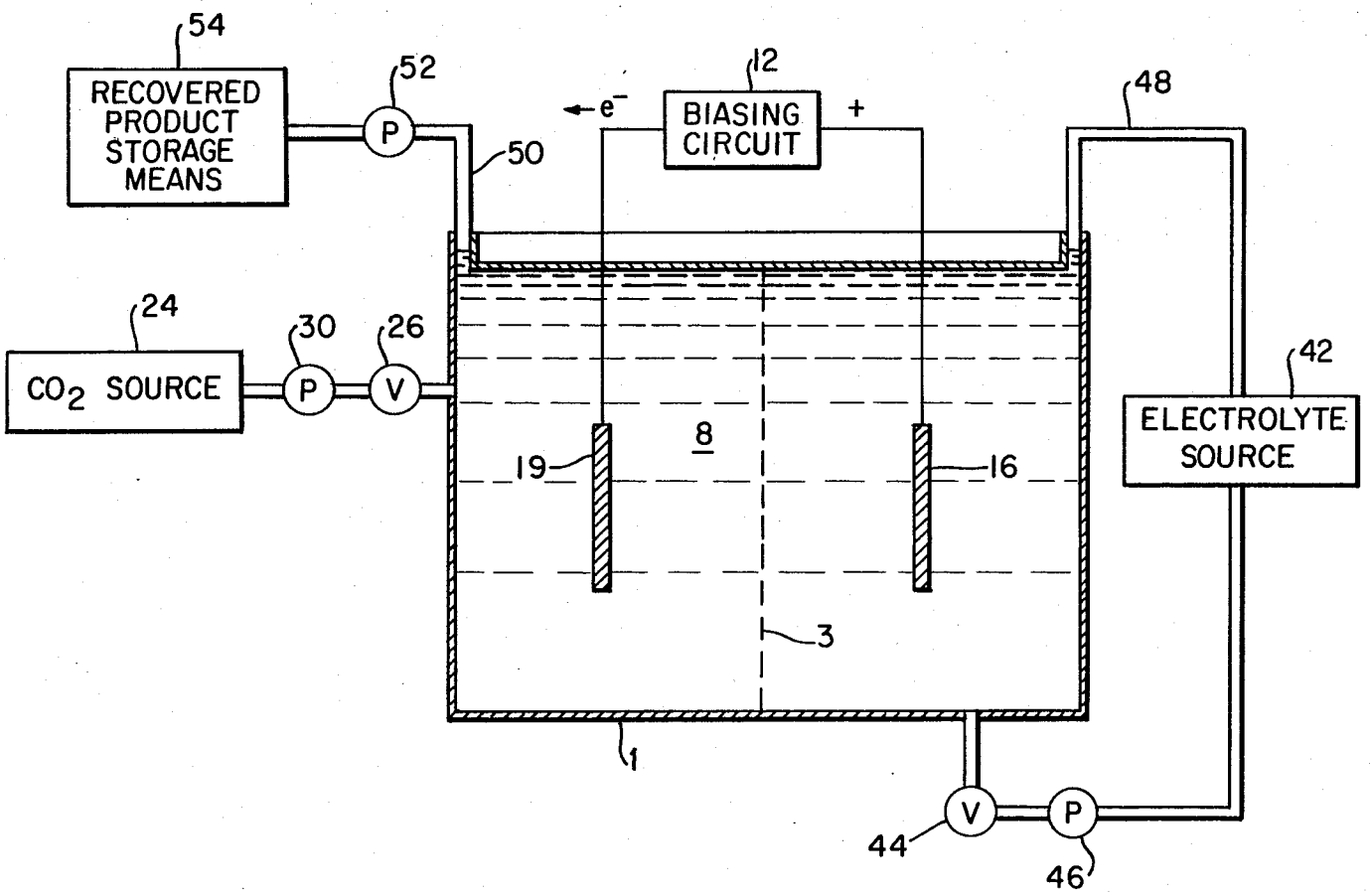
ELECTROLYTE SOURCE
42
48
46
44
16
3
8
1
19
BIASING CIRCUIT
12
+
e⁻
50
52
26
30
54
24
RECOVERED PRODUCT STORAGE MEANS
CO2 SOURCE
P
V

MEANS AND METHOD FOR THE ELECTROCHEMICAL REDUCTION OF CARBON DIOXIDE TO PROVIDE A PRODUCT

BACKGROUND OF THE INVENTION

Field of the Invention

The present invention relates to apparatus and method for the reduction of carbon dioxide to a product in general and, more particularly, to electrochemical apparatus and methods.

SUMMARY OF THE INVENTION

Apparatus and method for the electrochemical reduction of carbon dioxide to a product includes a housing divided into two sections by membrane. An electrolyte solution including a non-aqueous electrolyte dimethylformamide and a supporting electrolyte is provided to the two sections of the housing. A n-Si cathode is located in one section of the housing while an anode is located in the other section. Carbon dioxide is provided to the section having the cathode. A direct voltage is provided to the cathode and to the anode so that a current can pass and cooperate in a reaction between the carbon dioxide and the electrolyte solution to provide a product.

The objects and advantages of the invention will appear more fully hereinafter, from a consideration of the detailed description which follows, taking together the accompanying drawing, when one embodiment is illustrated by way of example. It is to be expressly understood, however, that the drawing is for illustrative purposes only, and it is not to be construed as defining the limits of the invention.

DESCRIPTION OF THE DRAWING

The drawing is in partial block diagram form and partial mechanical drawing form shows apparatus, constructed in accordance with the present invention, for the reduction of carbon dioxide to provide a product.

DESCRIPTION OF A PREFERRED EMBODIMENT OF THE INVENTION

Referring to the FIGURE, there is shown a housing 1 made of suitable material to contain an electrolyte solution having a membrane 3. The electrolyte permeable membrane 3 will pass ions. Contained within housing 1 is an electrolyte solution 8 including a non-aqueous electrolyte, such as dimethylformamide, and a supporting electrolyte selected from the following: tetrabutylammonium perchlorate, lithium perchlorate, magnesium perchlorate and ammonium perchlorate.

A biasing circuit 12 has a positive terminal connected to an anode 16 and a negative terminal connected to a cathode 19. Cathode 19 may consist of n-silicon, and has a gallium-indium ohmic contact. This ohmic contact is necessary to maintain a good electrical contact between the current collected and the n-Si. The n-Si allows essentially 100% current efficiency and particular high current densities to be achieved (greater than 200 $MA/Cm^2$). The ohmic contact area will be appropriately insulated from the electrolyte by use of suitable epoxy. Anode 16 may be a carbon or graphite base electrode. A source 24 provides carbon dioxide through a valve 26, using a pump 30, to housing 1. A source 42 provides the electrolyte solution 8 to housing 1 through a valve 44 aided by a pump 46. The electrolyte solution 8 leaving housing 1 is returned to electrolyte source 42 by way of a line 48.

Cathode 19 may have its operation enhanced by the use of a catalyst on cathode 19. Suitable catalysts are Group IV elements (germanium, carbon, tin) and metals such as mercury cadium, bismuth and indium.

The apparatus and method hereinbefore reduces carbon dioxide to either formate, oxalate, formate with formaldehyde or formate with oxalate.

What is claimed is:

1. Apparatus for the electrochemical reduction of carbon dioxide to provide a product comprising:

housing means for containing an electrolyte solution including dimethylformamide with a supporting electrolyte, means for dividing the housing means into two sections while permitting the electrolyte solution to move between the two sections, means for providing carbon dioxide to one section of the housing means, an n-Si cathode located in the section of the housing means receiving the carbon dioxide, an anode located in the section of the housing not receiving the carbon dioxide, means for providing a direct current voltage to the cathode and to the anode, to cooperate in a reaction between the carbon dioxide in the electrolyte solution to provide a product, and means for removing the product from the housing means.

2. Apparatus as described in claim 1 in which the supporting electrolyte is selected from the group consisting of magnesium perchlorate, tetrabutylammonium perchlorate, lithium perchlorate and ammonium perchlorate.

3. Apparatus as described in claim 2 in which the product is an oxalate.

4. Apparatus as described in claim 3 in which the anode is a carbon-graphite composition.

5. Apparatus as described in claim 4 in which the supporting electrolyte is lithium perchlorate.

6. Apparatus as described in claim 4 in which the supporting electrolyte is ammonium perchlorate.

7. Apparatus as described in claim 4 in which the supporting electrolyte is tetrabutylammonium perchlorate.

8. Apparatus as described in claim 4 in which the supporting electrolyte is magnesium perchlorate.

9. Apparatus as described in claim 2 in which the product is a formate.

10. Apparatus as described in claim 9 in which the product also includes formaldehyde.

11. Apparatus as described in claim 9 in which the product also includes oxalate.

12. An apparatus as described in claim 2 in which the cathode has a catalyst selected from the group consisting of germanium, carbon, tin, mercury, cadmium, bismuth, antimony and indium.

13. Apparatus as described in claim 1 in which the cathode has the catalyst selected from a group consisting of germanium, carbon, tin, mercury, cadmium, bismuth and indium.

14. A method for electrochemically reducing carbon dioxide to provide a product comprising the steps of:

containing an electrolyte solution including a non-aqueous electrolyte dimethylformamide with a supporting electrolyte, dividing the electrolyte into two portions with a membrane, providing carbon dioxide to one portion of the electrolyte, placing an n-Si cathode in the portion of the electrolyte means receiving the carbon dioxide, placing an anode in the portion of the electrolyte not receiving the carbon dioxide, and providing a direct current voltage to the cathode and to the anode, to cooperate in a reaction between the carbon dioxide and the electrolyte solution to provide a product.

15. A method as described in claim 14 in which the supporting electrolyte is selected from the group consisting of tetrabutylammonium perchlorate, lithium perchlorate, magnesium perchlorate and ammonium perchlorate.

16. A method as described in claim 15 in which the product is an oxalate.

17. A method as described in claim 16 in which the supporting electrolyte is lithium perchlorate.

18. A method as described in claim 16 in which the supporting electrolyte is ammonium perchlorate.

19. A method as described in claim 16 in which the supporting electrolyte is tetrabutylammonium perchlorate.

20. A method as described in claim 16 in which the supporting electrolyte is magnesium perchlorate.

21. A method as described in claim 15 in which the product is a formate.

22. A method as described in claim 21 in which the product also includes formaldehyde.

23. A method as described in claim 21 in which the product also includes oxalate.

24. A method as described in claim 15 in which the cathode has a catalyst selected from the group consisting of germanium, carbon, tin, mercury, cadmium, bismuth, antimony and indium.

25. Apparatus as described in claim 14 in which the cathode has the catalyst selected from a group consisting of germanium, carbon, tin, mercury, cadmium, bismuth and indium.

* * * * *